US008251730B2

(12) United States Patent
Wu

(10) Patent No.: US 8,251,730 B2
(45) Date of Patent: Aug. 28, 2012

(54) ELECTRICAL CONNECTOR ASSEMBLY WITH LATCH SYSTEM EASY TO OPERATING

(75) Inventor: Jerry Wu, Irvine, CA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 11 days.

(21) Appl. No.: 13/015,281

(22) Filed: Jan. 27, 2011

(65) Prior Publication Data

US 2011/0195595 A1 Aug. 11, 2011

(30) Foreign Application Priority Data

Feb. 8, 2010 (CN) ..... 2010 1 0301371

(51) Int. Cl.
*H01R 13/625* (2006.01)

(52) U.S. Cl. ..... 439/345

(58) Field of Classification Search ..... 439/345, 439/352, 358, 350, 357, 370, 488
See application file for complete search history.

(56) References Cited

U.S. PATENT DOCUMENTS 7,488,212 B2 * 2/2009 Chen ..... 439/607.01
2009/0246998 A1 * 10/2009 Wu ..... 439/352
2009/0247017 A1 * 10/2009 Wu ..... 439/660
2009/0253292 A1 * 10/2009 Wu ..... 439/493
2010/0317218 A1 * 12/2010 Wu ..... 439/352
2011/0005825 A1 * 1/2011 Wu ..... 174/359
2011/0280528 A1 * 11/2011 Wu ..... 385/101
2011/0281455 A1 * 11/2011 Wu ..... 439/345
2012/0015544 A1 * 1/2012 Wu ..... 439/345

* cited by examiner

*Primary Examiner* — Tulsidas C Patel
*Assistant Examiner* — Phuongchi Nguyen
(74) *Attorney, Agent, or Firm* — Wei Te Chung; Andrew C. Cheng; Ming Chieh Chang

(57) ABSTRACT

An electrical connector assembly includes an insulative housing defining at least two mating cavities arranged side by side in a widthwise direction and extending in a front and rear direction; two PCB modules received in each mating cavity in a stacked manner; a platform fitly attached to a top surface of the insulative housing and includes a pair of supporting sections disposed at a front edge thereof and a pair of connecting portion at a rear edge thereof; a pair of latches associated to the top surface of the insulative housing and comprising a locking portion for retaining a complementary connector and a pressed portion extending rearwards and disposed above the supporting portion ; and a driver rotatably retained on the pair of connecting portions of the platform and comprising a pair of contacting portions pressing against the pressed portions of the latches to urge the pressing portion downwards movement.

9 Claims, 20 Drawing Sheets

ELECTRICAL CONNECTOR ASSEMBLY WITH LATCH SYSTEM EASY TO OPERATING

FIELD OF THE INVENTION

The present invention generally relates to connectors suitable for transmitting data, more specifically to input/output (I/O) connectors with high-density configuration and high data transmitting rate.

DESCRIPTION OF RELATED ART

Mini SAS connectors are widely used in the server. And, a physical channel rate of the Mini SAS connector is reach to 3 Gbps. However, the above said data transmitting rate will not meet more and more higher data transmitting rate requirements of the server. For said requirements, the connector will has a developing trend to multiple mating ports. So it's difficult for the connector to assemble or separate with a complementary connector. Additionally, it will influence an electrical connection of the connector.

As discussed above, an improved electrical connector overcoming the shortages of existing technology is needed.

SUMMARY OF THE INVENTION

Accordingly, an object of the present invention is to provide an electrical connector assembly with latch system easy to operate and high data transmitting rate.

In order to achieve the above-mentioned objects, an electrical connector assembly, comprises an insulative housing defining at least two mating cavities arranged side by side in a widthwise direction and extending in a front and rear direction; two PCB (printed circuit board) modules received in each mating cavity in a stacked manner; a platform fitly attached to a top surface of the insulative housing, the platform comprising a pair of supporting sections disposed at a front edge thereof and a pair of connecting portion at a rear edge thereof; a pair of latches associated to the top surface of the insulative housing and comprising a locking portion for retaining a complementary connector and a pressed portion extending rearwards and disposed above the supporting portion; and a driver rotatably retained on the pair of connecting portions of the platform and comprising a pair of contacting portions pressing against the pressed portions of the latches to urge the pressing portion downwards movement.

Other objects, features and advantages of the invention will be apparent from the following detailed description taken in connection with the accompanying drawings.

DETAILED DESCRIPTION OF PREFERRED EMBODIMENTS

Figure 1:
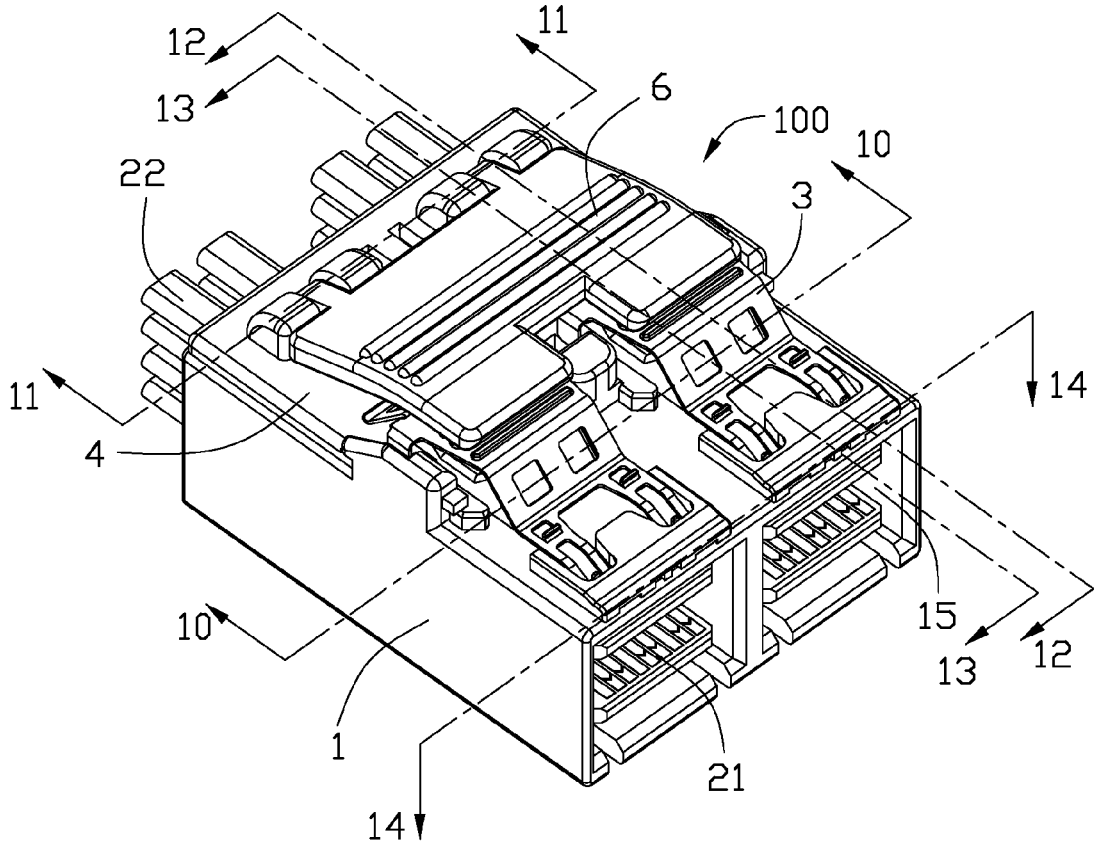
FIG. 1 is a front and top perspective view of an electrical connector assembly of a first embodiment of the present invention.

Reference will now be made to the drawing figures to describe the present invention in detail.

Figure 2:
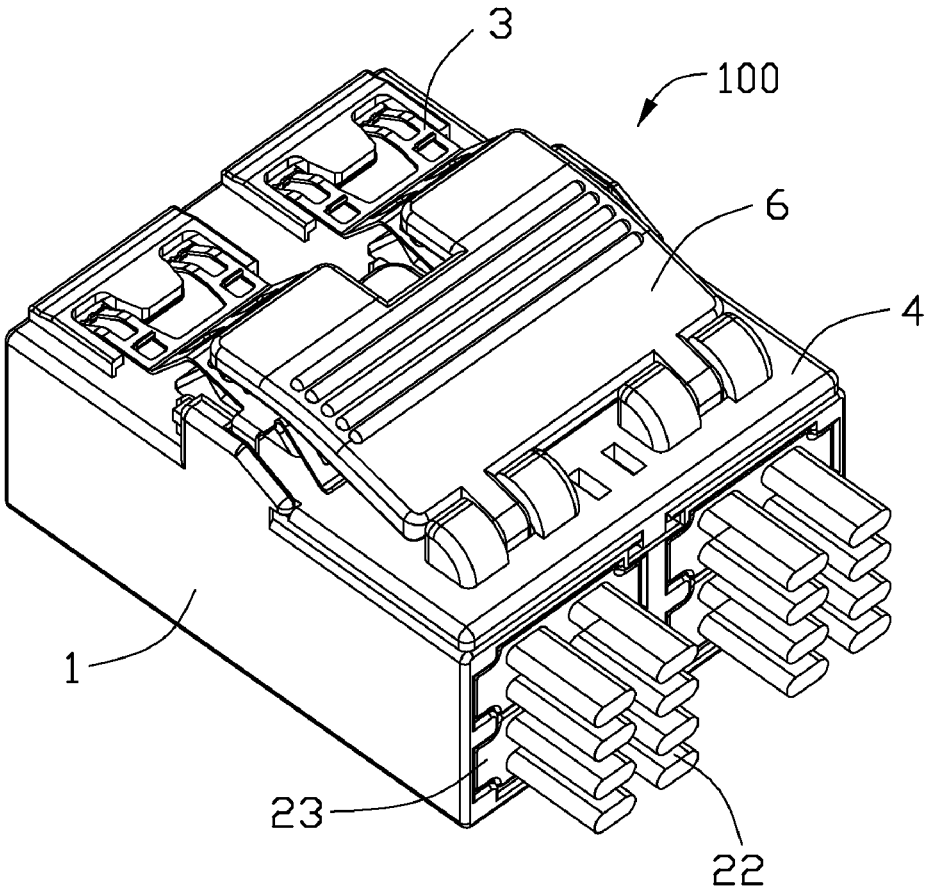
FIG. 2 is similar to FIG. 1, but viewed from a rear and top aspect.
Figure 3:
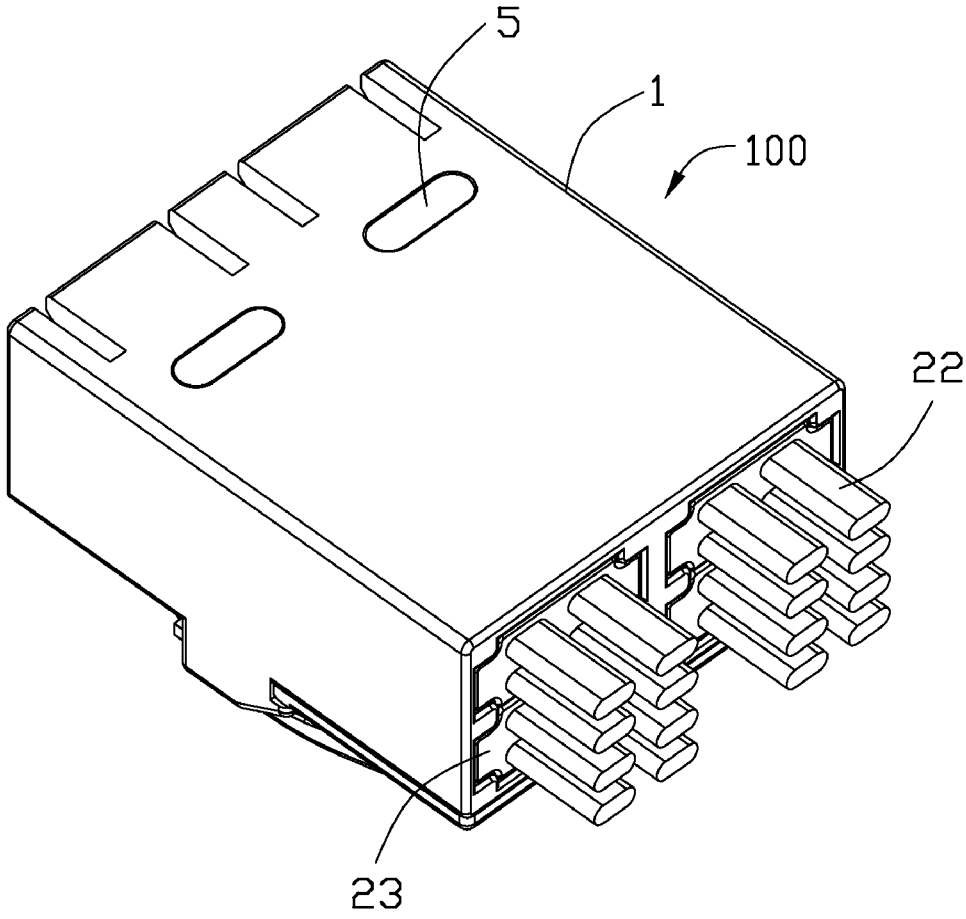
FIG. 3 is similar to FIG. 2, but viewed from a rear and bottom aspect.
Figure 4:
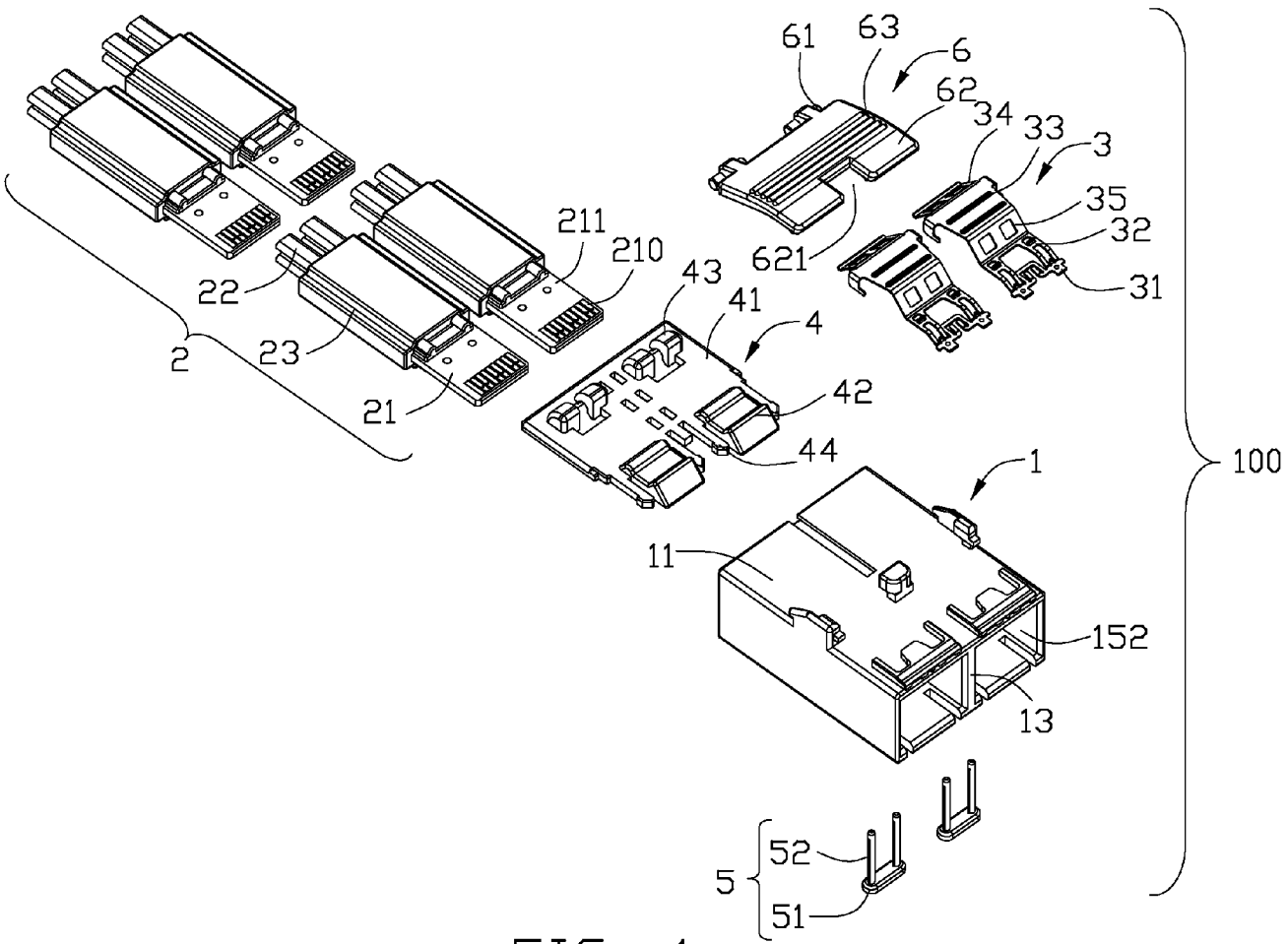
FIG. 4 is an exploded, perspective view of the electrical connector assembly of FIG. 1.
Figure 5:
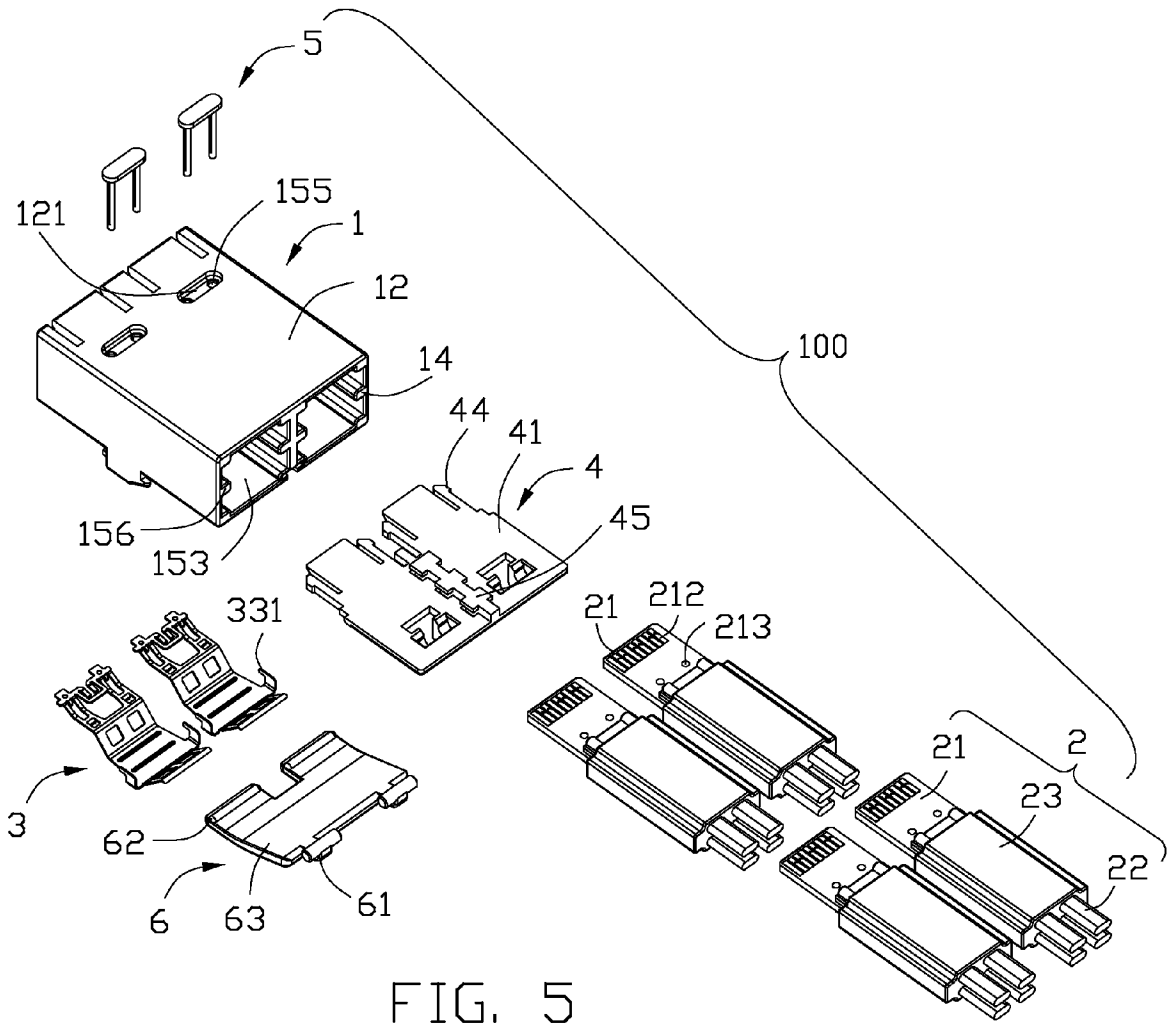
FIG. 5 is an exploded, perspective view of the electrical connector assembly of FIG. 3.

FIGS. 1 to 3 illustrate perspective views of an electrical connector assembly 100 of a first embodiment made in accordance with the present invention. Referring to FIGS. 4 to 5, the electrical connector assembly 100 comprises a box-shape insulative housing 1, four PCB (printed circuit board) modules 2 disposed in the insulative housing 1, a platform 4 disposed on a top surface 11 of the insulative housing 1 and engaged with the insulative housing 1, two latches 3 assembled to a top surface 11 of the insulative housing 1 and having a portion located upon the platform 4 and two retainers 5 to assemble the four PCB modules 2 in the insulative housing 1. The electrical connector assembly 100 further has a driver 6 rotatably assembled to a back end of the platform 4 and pressing the portion of the latches 3. The couple of the latches 3 and the driver 6 are functioned as a latch system of the electrical connector assembly 100.

Figure 12:
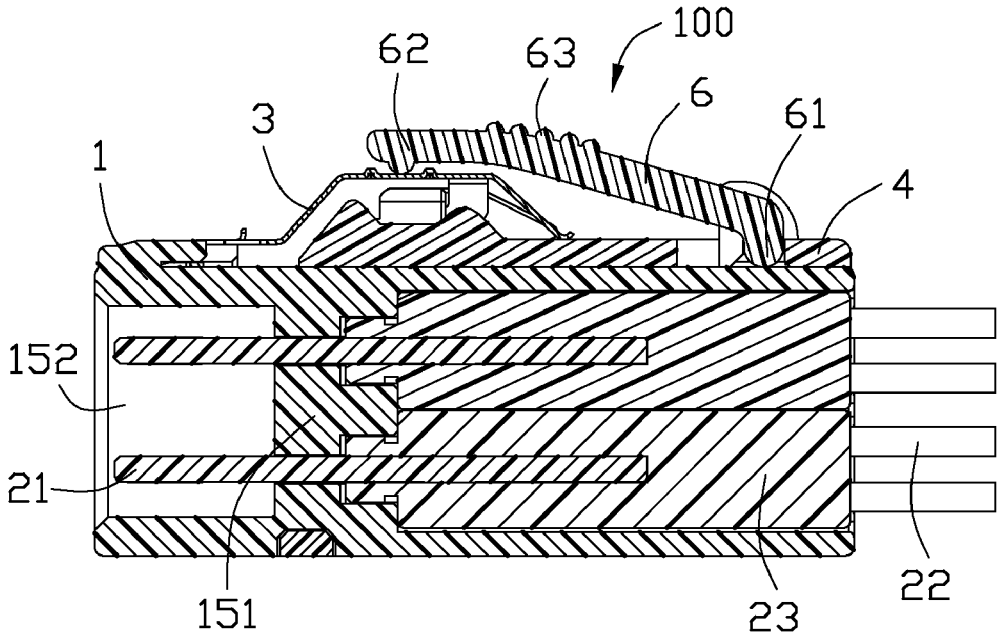
FIG. 12 is a cross section view of the electrical connector assembly of FIG. 1 taken along line 12-12.
Figure 13:
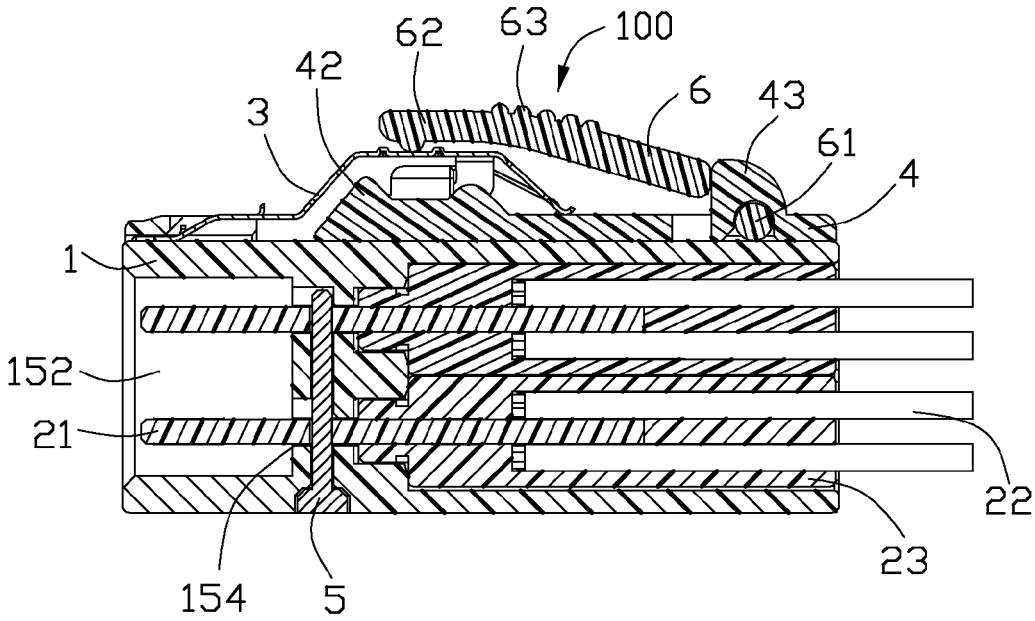
FIG. 13 is a cross section view of the electrical connector assembly of FIG. 1 taken along line 13-13.

Referring to FIGS. 4 and 5, the insulative housing 1 defines a top surface 11, a bottom surface 12 opposite to the top surface 11, a front surface 13 and a rear surface 14 opposite to the front surface 13. The insulative housing defines two mating cavities 15 labeled in FIG. 1 arranged side by side in a widthwise direction and extending from the front surface 13 through the rear surface 14. Combination with FIGS. 12 and 13, each mating cavity 15 is divided to a front receiving room 152 and a rear receiving room 153 by an integral middle partition 151 and the front and the rear receiving room communicate with each other by two widthwise slots 154 in the upper to lower direction. Each rear receiving room 153 defines a pair of inwards separators 156 extending inwardly from right and left inner surfaces thereof and dividing the rear receiving room 153 into an upper room and a bottom room for retaining two PCB modules 2 arranged in a stacked manner.

Figure 10:
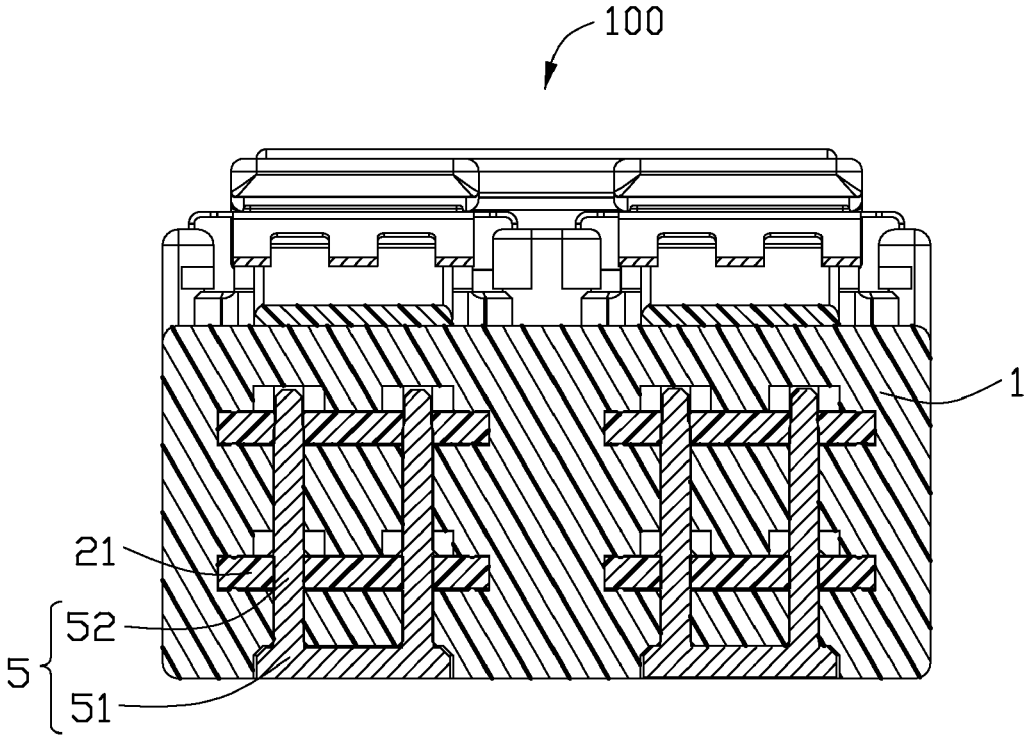
FIG. 10 is a cross section view of the electrical connector assembly of FIG. 1 taken along line 10-10.

The retainer 5 is made of insulative material and has a base portion 51 and a pair of positioning posts 52 extending from a top surface thereof for a distance. Combination with FIGS. 10 and 12, the insulative housing 1 define a pair of recesses 121 recessed from the bottom surface 12 and arranged in the widthwise direction. Each recess 121 is aligned with the partition 151 in a vertical direction. The partition 151 defines a pair of vertical receiving holes 155 arranged along a transverse direction and extending downwardly and communicated with the recess 121. Each receiving hole 155 is crossed with two slots 154. The pair of positioning posts 52 are received into the receiving holes 155 of the partition 151 and passed through the positioning holes 213 of the printed circuit boards 21. Thus, the retainers 5 are interfered with the PCB modules 2. The base portion 51 of the retainer 5 is received into the recess 121.

The four PCB modules 2 have same structures, each comprises a printed circuit board 21, a plurality of cables 22 electrically connected with a rear end of the printed circuit board 21 and an insulator 23 over-molding around a front end of the cables 22 and a rear end of the printed circuit board 21 for protecting a connection between the printed circuit board 21 and the cables 22. The printed circuit board 21 defines a mating section 210, a connecting section 211 disposed at back of the mating section 210 and exploding to a front edge of the insulator 23 and a soldering section (not figured) embedded in the insulator 3 to be electrically connected with the cables 22. The mating section 210 defines a plurality of conductive pads 212 formed on two opposite upper and lower surfaces and arranged along a front edge thereof in the widthwise direction. The connecting section 211 defines two positioning holes 213 spaced apart with each other and arranged along the widthwise direction. Combination with FIGS. 12 and 13, the four PCB modules 2 are inserted into the two mating cavities 15 of the insulative housing 1 along from a rear to front direction. Each two PCB modules 2 are arranged in a stacked manner when the two PCB modules 2 are fully received into the receiving space 15. The mating sections 210 of the printed circuit boards 21 are passed through two widthwise slots 154 of the partition 151 and received into the front receiving room 152. The insulators 23 are filled in the rear receiving room 153. The positioning holes 213 of the connecting section 211 are in alignment with two receiving holes 155 defined in the partition along a vertical direction to receive the retainer which will described hereinafter.

Figure 8:
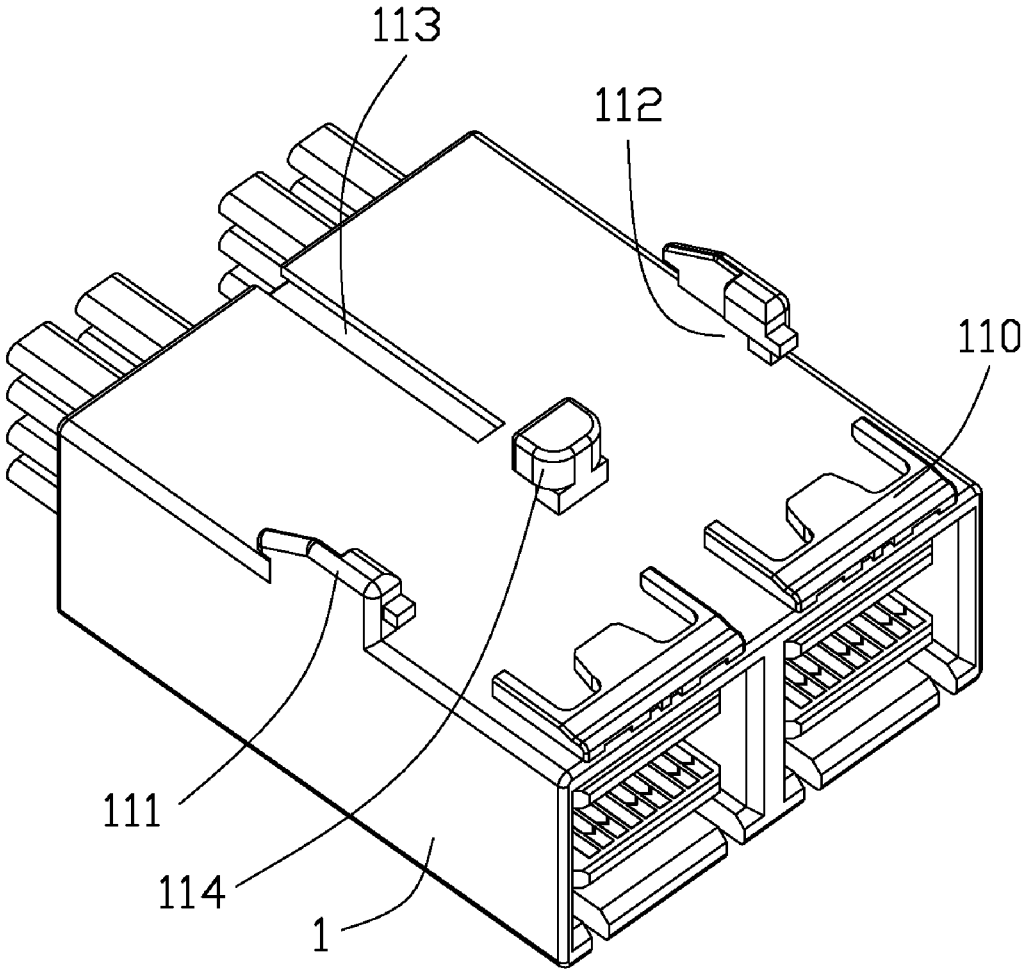
FIG. 8 is a partially assembled view of the electrical connector assembly of FIG. 6.
Figure 9:
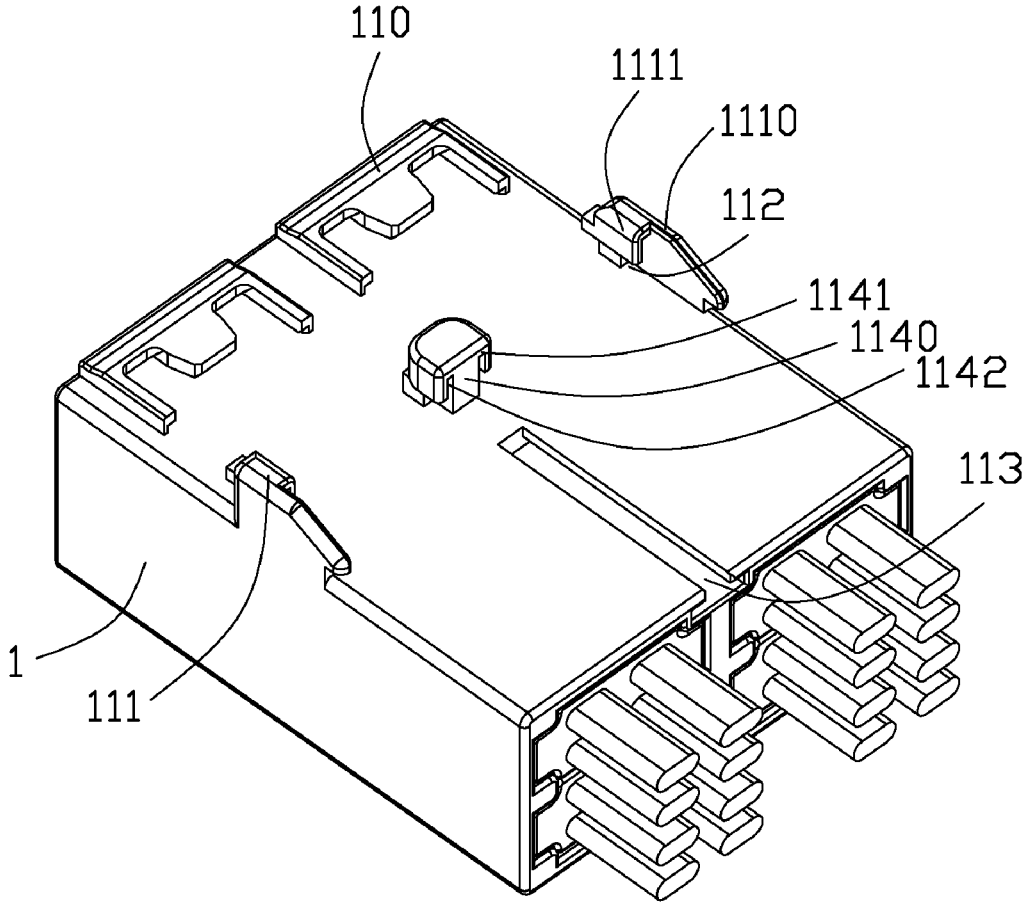
FIG. 9 is a partially assembled view of the electrical connector assembly of FIG. 7.

Referring to FIGS. 8 and 9, the insulative housing 1 further defines a pair of generally M-shaped interferential portions 110 spaced apart with each other and integrally arranged on a front end of the top surface 11 in the widthwise direction for engaging with a front ends of the latches 3, which are located corresponding to mating cavities 15, and a pair of positioning portions 111 disposed in back of the interferential portion 110 for locking the platform 4 and limiting a back end of the latch 3 in a down to up direction. The pair of positioning portions 111 is symmetrically disposed at two sides of the top surface 11. A tuber 114 projects from the top surface 11 between the pair of positioning portions 111 for retaining the back ends of the latches. Each positioning portion 111 defines a vertical base section 1110 extending upwardly from the top surface 11 and a horizontal limiting section 1111 extending inwardly from an inner surface of the base section 1110 and spaced apart with the top surface 11. So, a limiting space 112 is formed between the top surface 11 of the insulative housing 1 and the limiting section 1111. The tuber 114 defines a second vertical base section 1140 extending upwardly from the top surface 11 and a pair of second horizontal limiting sections 1141 extending from two sides of the second vertical base section 1140. A second limiting space 1142 is formed between the top surface 11 and the second limiting section 1141. The insulative housing 1 defines a slit 113 extending in a front to back direction on a back end of the top surface thereof. The slit is an inverted T shaped cross section in the widthwise direction.

Figure 6:
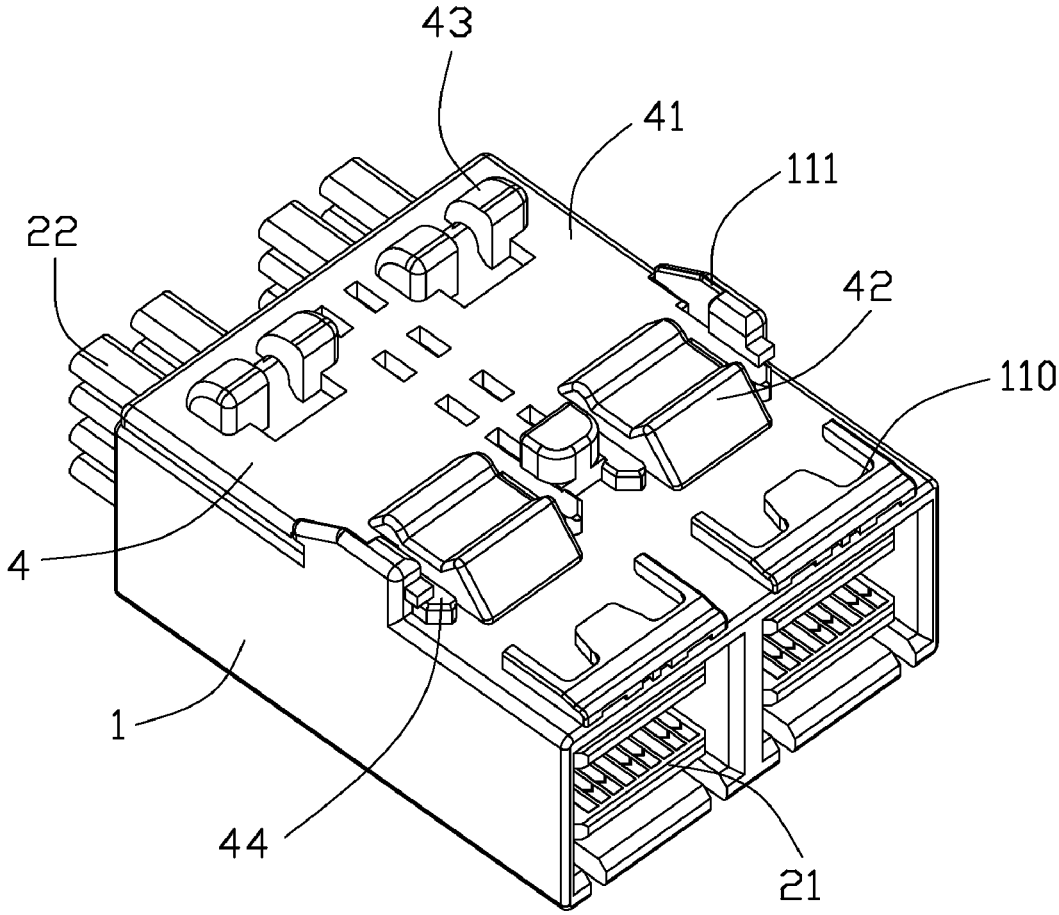
FIG. 6 is a partially assembled view of the electrical connector assembly of FIG. 1.
Figure 7:
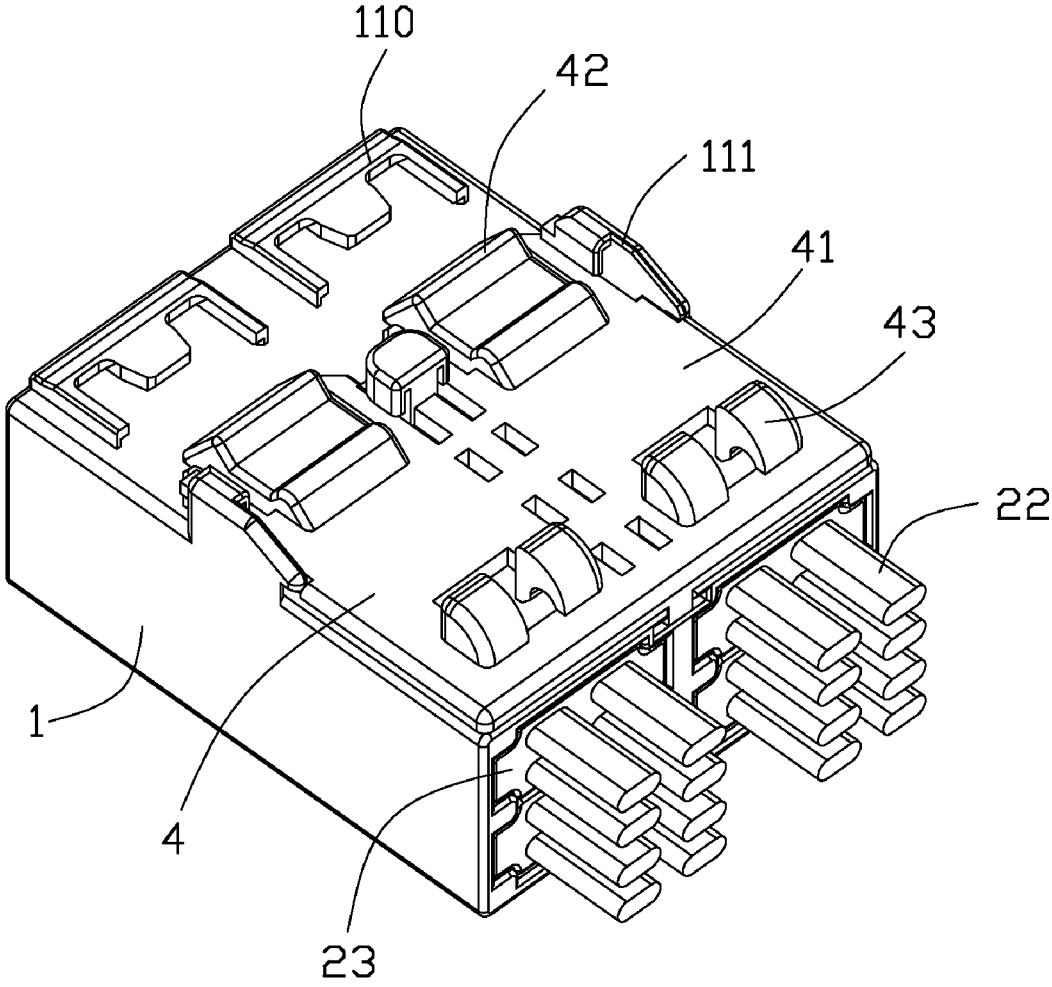
FIG. 7 is an another partially assembled view of the electrical connector assembly of FIG. 2.
Figure 11:
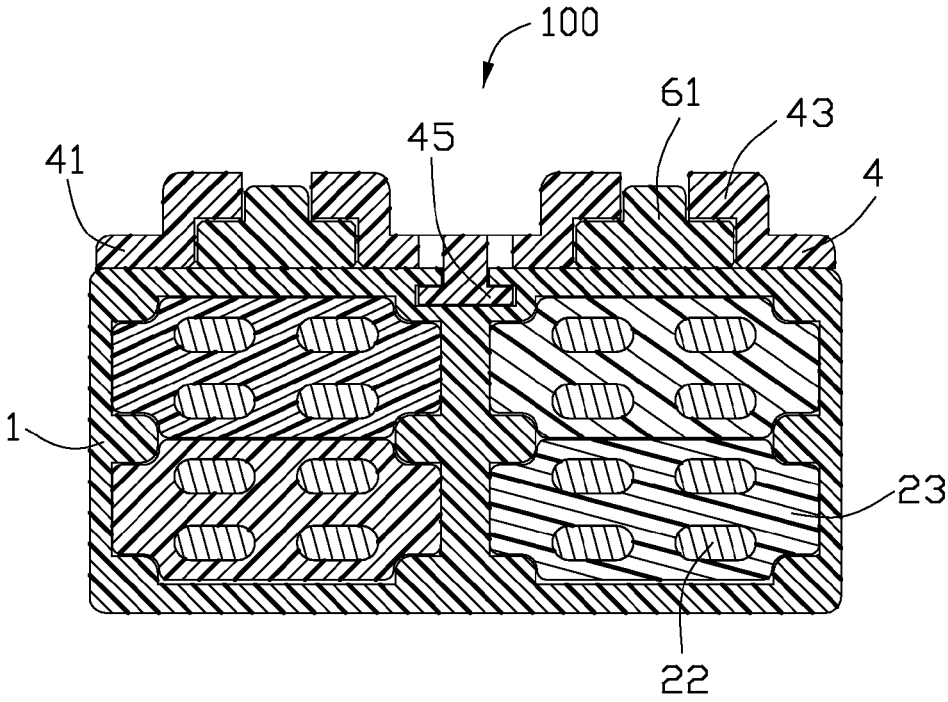
FIG. 11 is a cross section view of the electrical connector assembly of FIG. 1 taken along line 11-11.
Figure 14:
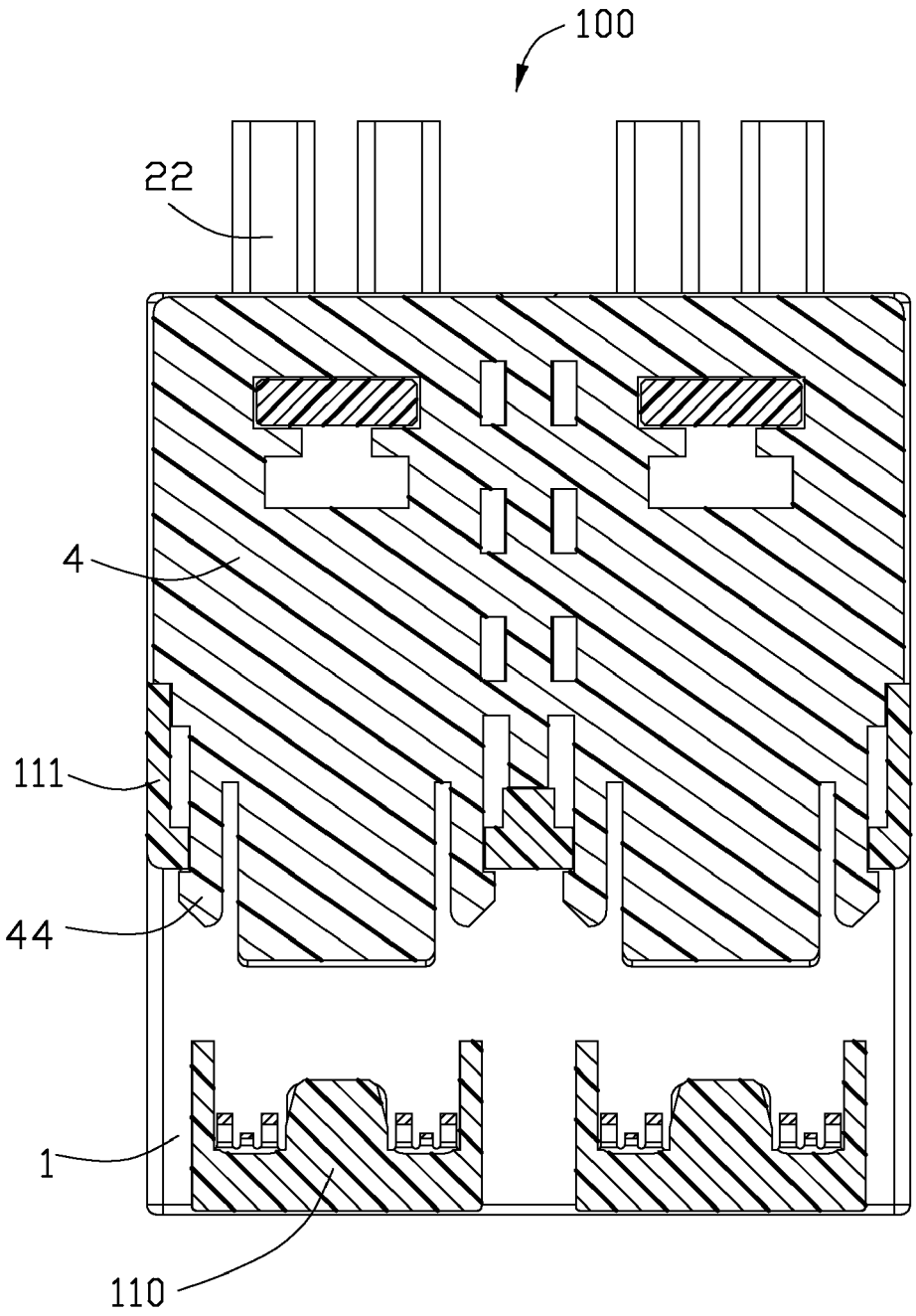
FIG. 14 is a cross section view of the electrical connector assembly of FIG. 1 taken along line 14-14.

Referring to FIGS. 4 to 5, the flat platform 4 is made of insulative material. The platform 4 is attached to the top surface 11 of the insulative housing 1 by being retained on the pair of positioning portions 111 and the tuber 114. The platform 4 defines a main section 41, a pair of supporting sections 42 extending forwardly from a front end of the main section 41, a pair of connecting sections 43 defined at the back end of the main section 41 and a pair of elastic latching sections 44 disposed at two sides of each supporting section 42. The main section 41 has a retention part 45 defined on a bottom surface thereof and extending in a front to back direction. Combination with FIGS. 6 and 7, the retention part 45 of the bottom surface of the main section 41 slides into and is received in the slit 113 of the top surface 11 of the insulative housing 1 as best shown in FIG. 11 so as to make the bottom surface of the main section 41 abutted against the top surface 11. Each pair of latching sections 44 are received in the limiting space 112, 1142 of the positioning portion 111 and a side of the tuber 114 with front hooks being locked with front edges of the positioning portion 111 and the tuber 114 as best shown in FIG. 14. Each supporting section 42 is disposed between the positioning portion 111 and the tuber 114 and aligned with the corresponding interferential portions and the corresponding connecting sections in the front to rear direction. The main section 41 is disposed in back of the pair of positioning portions 111.

Referring to FIGS. 4 to 5, the latch 3 is stamped from a metallic plate and comprises a retaining portion 31, a pair of locking portions 32 extending upwardly and rearwardly from the retaining portion 31, a pressed portion 33 formed at a rear position of the pair of locking portions 32, and an inclined supporting portion 34 slantwise extending from the pressed portion 33. The latch 3 further forms a generally intermediate portion 35 connecting the pressing portion 33 with the locking portions 32. The pressed portion 33 defines a pair of protruding pieces 331 respectively formed on two sides thereof. Combination with FIGS. 1 and 2, a forward pressing force is exerted on the latch 3. The retaining portion 31 is engaged with the interferential portion 110 to make the latch 3 positioned on the top surface 11. The pressed portion 33, the inclined supporting portion 34, the inclined intermediate portion 35 and the locking portions 32 are cantilevered relative to the retaining portion 31. The pair of protruding pieces 331 of the pressed portion 33 are interferential with the positioning portion 111 and the tuber 114 and received in the limiting space 112 of the positioning portion 111 and the second limiting space 1142 of the tuber 114 to limit the excessive movement of the pressed portion 33 in a down to up direction.

Referring to FIGS. 4 to 5, the driver 6 is made of insulative material and has a pair of shafts 61 at the back thereof connected to the pair of connecting portions 43 of the platform 4, a pair of contacting portions 62 at a front end thereof and respectively located on the pressed portion 33 of the latch 3 and an operation portion 63 between the pair of shafts 61 and the pair of contacting portions 62. A cutout 621 corresponding to the tuber 114 of the insulative housing 1 is surrounded by the pair of contacting portions 62 and the operation portion 63. Combination with FIGS. 1 and 12, the pair of shafts 61 is rotatably secured to the pair of connecting portion 43 of the platform 4. The contacting portion 62 of the front end of the platform 4 is located above the pressed portions 33 of the two latches 3.

After the platform 4 is assembled to the insulative housing 1, the latch 3 is assembled to the top surface 11 of the insulative housing 1. Then the driver 6 is assembled to the platform 4. When a down force is exerted on the operation portion 63 of the driver 6, the contacting portion 62 of the front end of the driver 6 begins to move downwardly and drives the pressed portions 33 of the two latches 3 to move downwardly. Thus, the locking portions 32 of the two latches 3 also can move downwardly for easily assembling the electrical connector assembly to a complementary connector (not shown). After the assembling of the electrical connector assembly 1 and the complementary connector is completed, the down force exerted on the operation portion 63 is released, the two latches recover original shape and retain the complementary connector.

Figure 15:
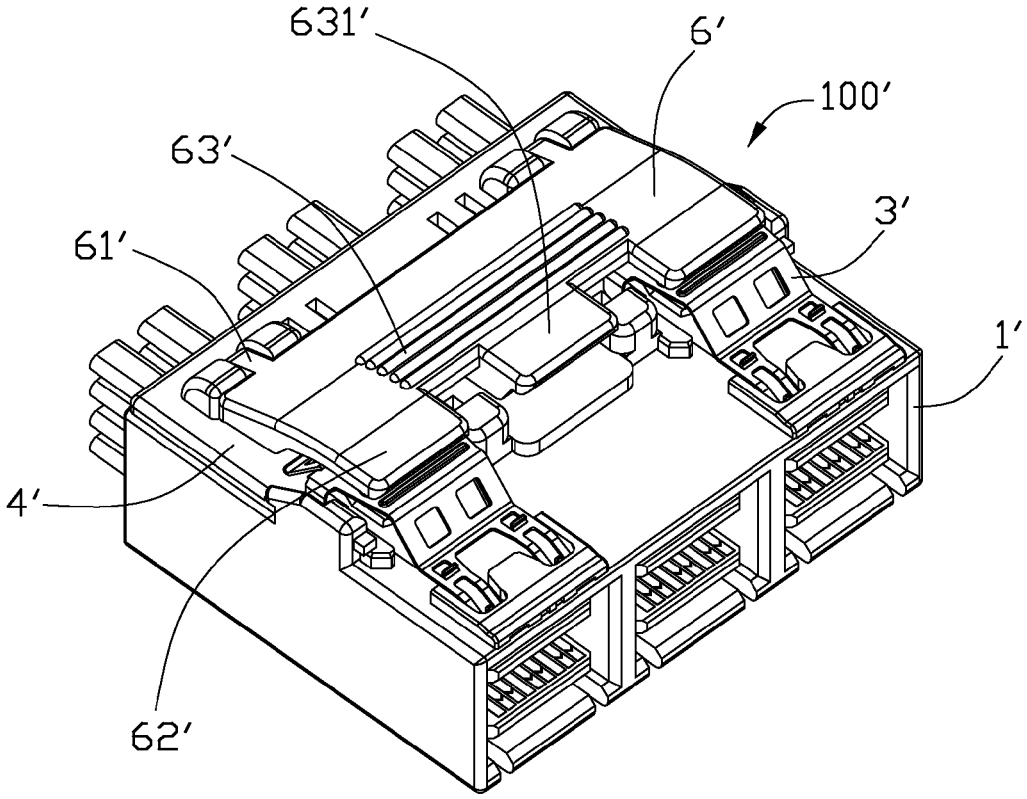
FIG. 15 is a perspective view of an electrical connector assembly of a second embodiment of the present invention.
Figure 16:
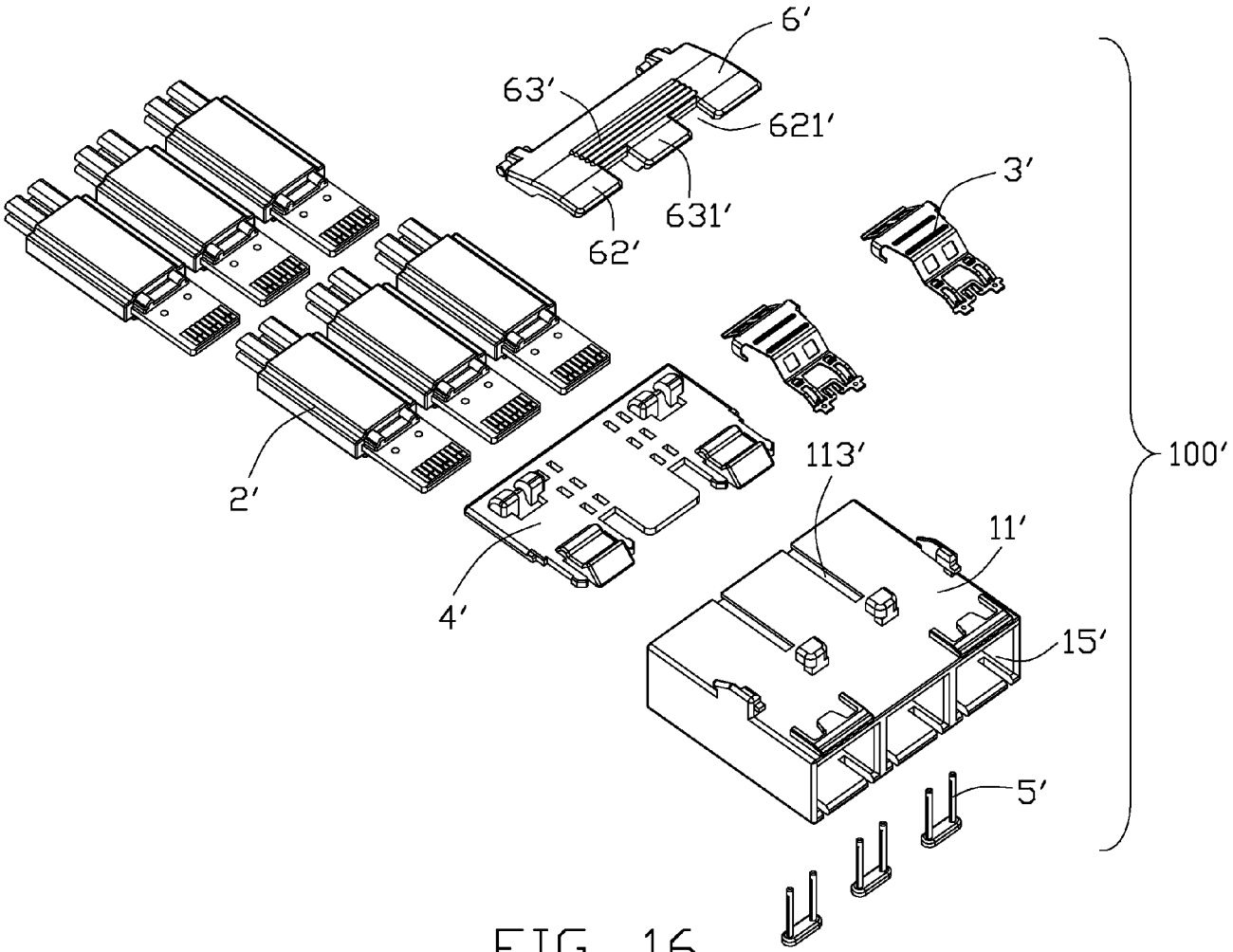
FIG. 16 is an exploded, perspective view of the electrical connector assembly of FIG. 15.
Figure 17:
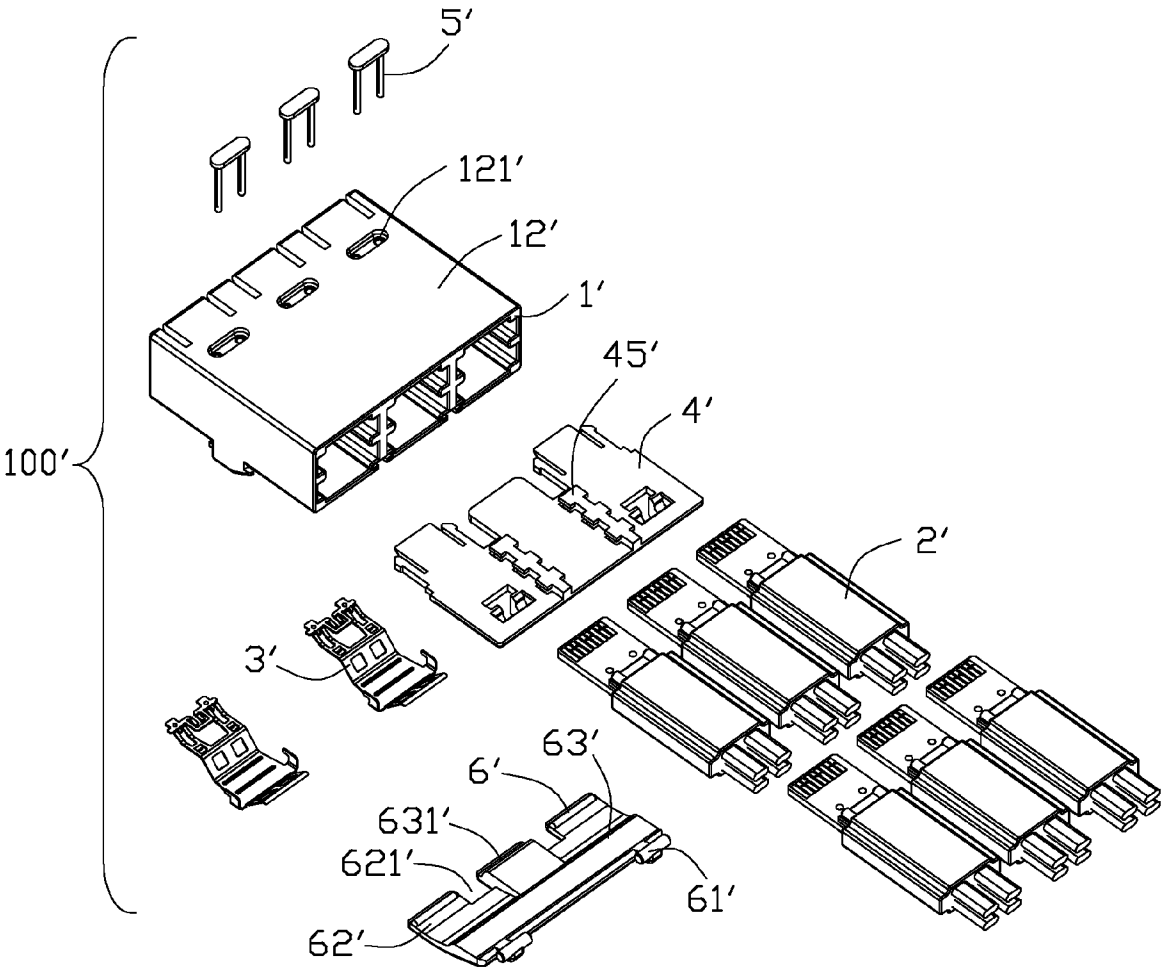
FIG. 17 is similar to FIG. 16, but viewed from another aspect.

Referring to FIGS. 15 to 17, the electrical connector assembly 100' of a second embodiment of the present invention comprises a box-shape insulative housing 1' with three side-by-side mating cavities 15' with two PCB modules 2' in each mating cavity 15', a platform 4' disposed on a top surface 11' of the insulative housing 1', two latches 3' assembled to a top surface 11' of the insulative housing 1' corresponding to the two outer mating cavities 15' and three retainers 5' to assemble the PCB modules 2' in the insulative housing 1'. The electrical connector assembly 100' further has a driver 6' rotatably assembled to a back end of the platform 4' and pressing the portion of the latches 3'. The couple of the latches 3' and the driver 6' are functioned as a latch system of the electrical connector assembly 100'. The electrical connector assembly 100' of the second embodiment is the same as the electrical connector assembly 100 of the first embodiment at the process of assembling and operation principle.

The difference between the electrical connector assembly 100' of the second embodiment and the electrical connector assembly 100 of the first embodiment is that the insulative housing 1' has three mating cavities 15' arranged side by side in a widthwise direction. Thus, the insulative housing 1' is wider than the insulative housing 1. The insulative housing 1' defines an additional slit 113' on the top surface 11' and an additional recess 121' on the bottom surface 12' compared to the insulative housing 1 of the first embodiment. The platform 4' is wider than the platform 4 of the first embodiment in a widthwise direction, because the insulative housing 1' become wider in a widthwise direction. The two side structures of the platform 4' are same as the platform 4 of the first embodiment. The middle portion of the platform 4' is wider than the platform 4 of the first embodiment in a widthwise direction. At the same time, the platform 4' defines an additional retention part 45' on the bottom surface thereof and assembled to the slit 113' on the top surface 11' of the insulative housing V. Each latch 3' is same as the latch 3 of the first embodiment. The widthwise distance of the driver 6' is increased compared to the driver 6 of the first embodiment to make the driver 6' to control the latches 3' at the two sides of the insulative housing 1' accurately. The driver 6' defines a pair of contacting portions 62' and a cutout 621' between the contacting portions 62'. A extending portion 631' extends forwardly from a front edge of an operation portion 63' into the cutout 621' for increasing the pressing area of the operation portion 63'. It's easy for user to operate.

Figure 18:
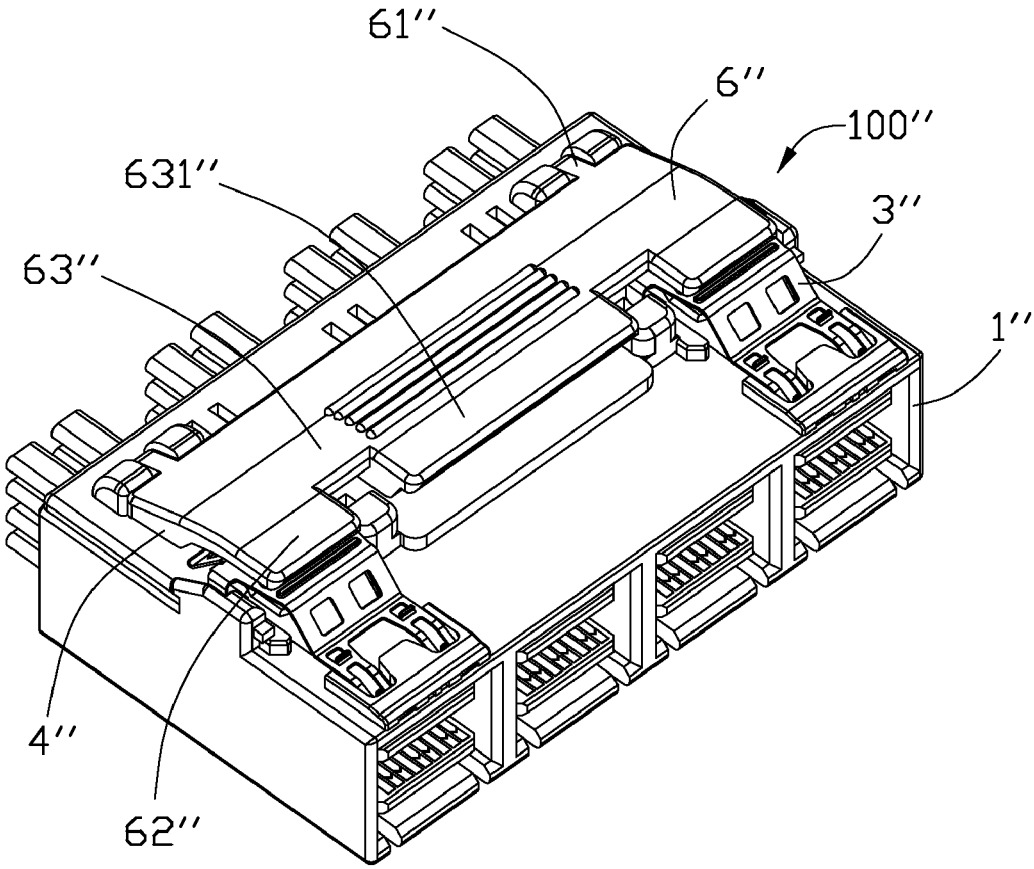
FIG. 18 is a perspective view of an electrical connector assembly of a third embodiment of the present invention.
Figure 19:
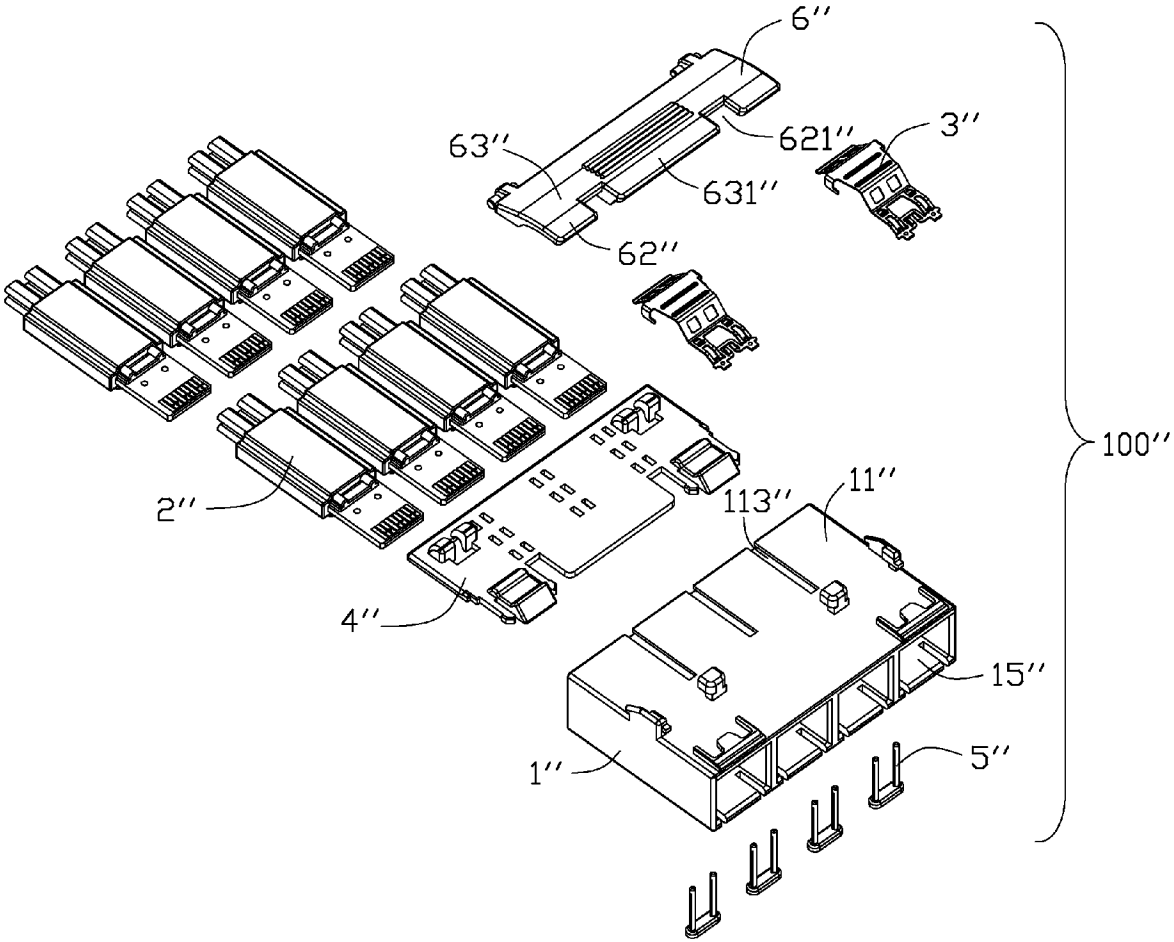
FIG. 19 is an exploded, perspective view of the electrical connector assembly of FIG. 18.
Figure 20:
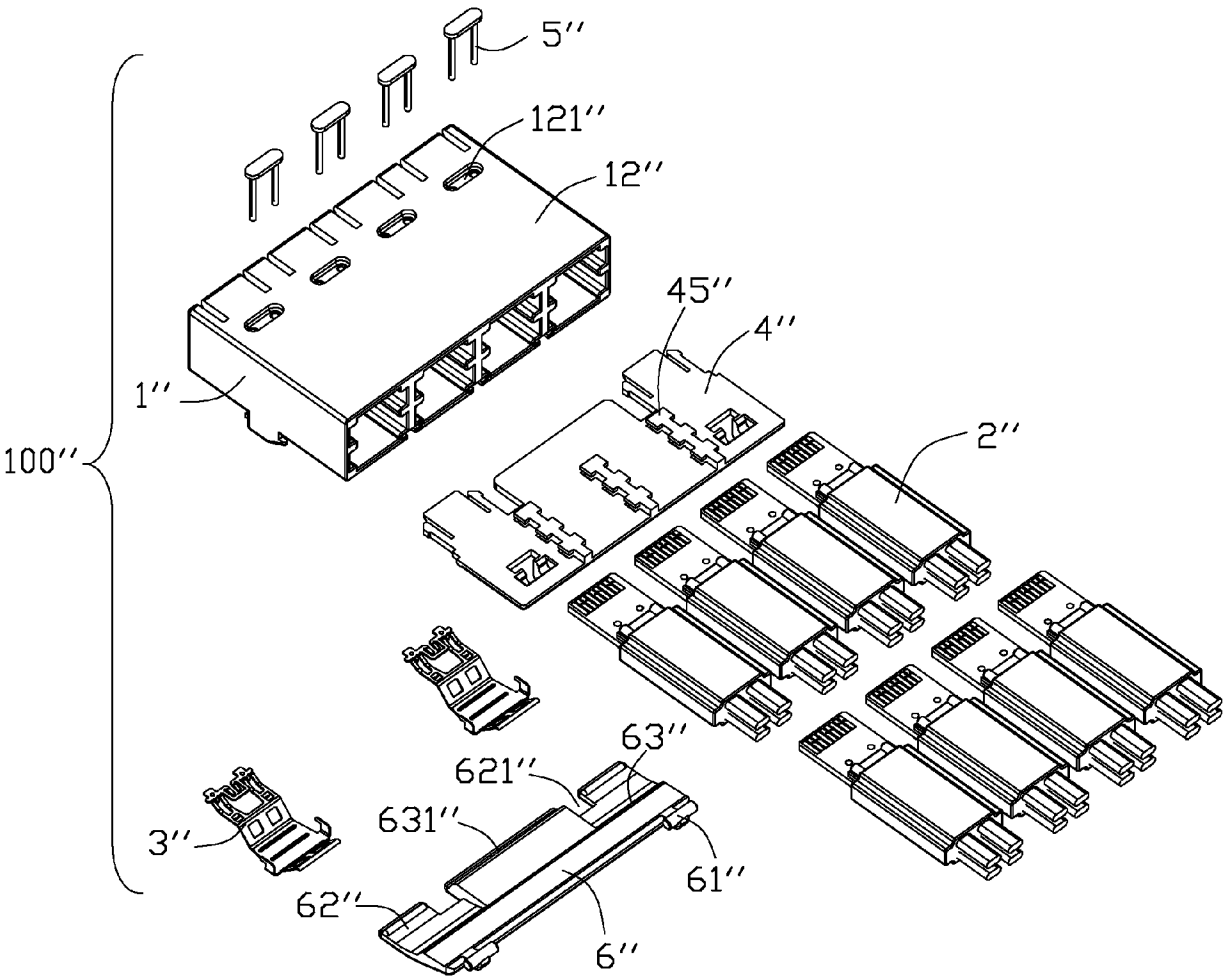
FIG. 20 is similar to FIG. 19, but viewed from another aspect.

Referring to FIGS. 18 to 19, the electrical connector assembly 100" of a third embodiment of the present invention comprises a box-shape insulative housing 1" with three side-by-side mating cavities 15" with two PCB modules 2" in each mating cavity 15", a platform 4" disposed on a top surface 11" of the insulative housing 1", two latches 3" assembled to two sides of a top surface 11" of the insulative housing 1" corresponding to the two outer mating cavities 15" and three retainers 5" to assemble the PCB modules 2" in the insulative housing 1". The electrical connector assembly 100" further has a driver 6" rotatably assembled to a back end of the platform 4" and pressing the portion of the latches 3". The couple of the latches 3" and the driver 6" are functioned as a latch system of the electrical connector assembly 100". The electrical connector assembly 100" of the third embodiment is the same as the electrical connector assembly 100, 100' of the first and second embodiment at the process of assembling and operation principle.

The difference between the electrical connector assembly 100" of the third embodiment and the electrical connector assembly 100 of the first embodiment is that the insulative housing 1" has four mating cavities 15" arranged side by side in a widthwise direction. Thus, the insulative housing 1" is wider than the insulative housing 1. The insulative housing 1" defines two additional slits 113" on the top surface 11" and two additional recesses 121" on the bottom surface 12" compared to the insulative housing 1 of the first embodiment. The platform 4" is wider than the platform 4 of the first embodiment in a widthwise direction, because the insulative housing 1" become wider in a widthwise direction. The two side structures of the platform 4" are same as the platform 4 of the first embodiment. The middle portion of the platform 4" is wider than the platform 4 of the first embodiment in a widthwise direction. At the same time, the platform 4" defines two additional retention part 45" on the bottom surface thereof and assembled to the slits 113" on the top surface 11" of the insulative housing 1". Each latch 3" is same as the latch 3 of the first embodiment. The widthwise distance of the driver 6" is increased compared to the driver 6 of the first embodiment to make the driver 6" to control the latches 3" at the two sides of the insulative housing 1" accurately. The driver 6" defines a pair of contacting portions 62" and a cutout 621" between the contacting portions 62". A extending portion 631" extends forwardly from a front edge of an operation portion 63" into the cutout 621" for increasing the pressing area of the operation portion 63". It's easy for user to operate.

The electrical connector assemblies 100, 100', 100" of three embodiments of the present invention all have a pair of latches 3, 3', 3" and a driver 6, 6', 6" controlling the latches to make the electrical connector assembly 100, 100', 100" assembling to or separating from the complementary connector (not shown). Thus, it's easy for user to operate.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector assembly, comprising:

an insulative housing defining at least two mating cavities arranged side by side in a widthwise direction and extending in a front and rear direction;

two PCB (printed circuit board) modules received in each mating cavity in a stacked manner;

a platform fitly attached to a top surface of the insulative housing, the platform comprising a pair of supporting sections disposed at a front edge thereof and a pair of connecting portion at a rear edge thereof;

a pair of latches associated to the top surface of the insulative housing and comprising a locking portion for retaining a complementary connector and a pressed portion extending rearwards and disposed above the supporting portion ; and a driver rotatably retained on the pair of connecting portions of the platform and comprising a pair of contacting portions pressing against the pressed portions of the latches to urge the pressing portion downwards movement;

said pair of latches is assembled at two sides of the top surface of the insulative housing, at least one tuber projects from the top surface between the pair of latches for retaining the latches, the driver defines a cutout corresponding to the tuber;

the insulative housing defines an interferential portion formed on the top surface thereof and engaged with a front end of the latch, and a pair of positioning portions disposed in back of the interferential portion for locking the platform and limiting the back end of the latch in a down to up direction.

2. The electrical connector assembly as claimed in claim 1, wherein a slit is defined on the top surface of the insulative housing and extends in back to front direction, the platform defines a retention part extending downwardly and sliding into the slit in a back to front direction.

3. The electrical connector assembly as claimed in claim 1, wherein each PCB module has a printed circuit board, a plurality of cables electrically connected to the printed circuit board and an insulator over-molding around a rear end of the printed circuit board and a front end of the plurality of cables.

4. The electrical connector assembly as claimed in claim 3, wherein each mating cavity defines a partition dividing the mating cavity to a front receiving room and a rear receiving room, each printed circuit board defines a mating section at a front end thereof and passing through the partition and received in the front receiving room.

5. The electrical connector assembly as claimed in claim 3, wherein the electrical connector assembly further includes a retainer assembled to the insulative housing and interfered with the two PCB modules to make the insulative housing and the two PCB modules positioned with each other.

6. An electrical connector, comprising:

an insulative housing having at least two mating cavities arranged in a widthwise direction and each extending in a front and rear direction;

conductive means contained in each mating cavity;

a pair of metal latches associated with a top face, which are located just above two outermost mating cavities of the at least two mating cavity respectively, each latch comprises a locking portion at a front end of top face and a pressed portion extending rearwards;

an insulative driver rotatably associated with the top surface at a back end thereof and comprising contacting portions pressing against the corresponding pressed portions of the latches;

the electrical connector further has a platform fitly attached to the top surface of the insulative housing and located at back of the latch;

the platform define a main section at the back of the latch, a pair of supporting sections extending forwardly from a front end of the main section below the pressed portion of the latch, and a pair of connecting sections defined at the back end of the main section for retaining the back end of the driver.

7. An electrical connector assembly comprising:

an housing defining more than three mating ports side by side arranged with one another along a transverse direction;

a plurality of cable units located behind the housing and respectively mechanically and electrically connected to the corresponding mating ports;

a pair of latch members disposed upon an exterior face of the housing and essentially aligned with two outermost mating ports in a vertical direction perpendicular to said transverse direction; and a single actuator mounted to the housing and simultaneously operating both said pair of latch members; wherein no additional latch member is located between, in said transverse direction, said pair of latch members corresponding to the remaining mating ports between said pair of outermost mating ports;

said actuator is pivotally moveable relative to the housing technically;

a pivot of the actuator is located at a rear end of the actuator and away from the corresponding latch members; a front end of the actuator actuates a rear portion of the corresponding latch member;

a finger pressing region of the actuator is located between the pair of latch members in said transverse direction;

the finger pressing region is around the front end of the actuator.

8. The electrical connector assembly as claimed in claim 7, wherein said actuator is roughly up and down moveable relative to the housing.

9. The electrical connector assembly as claimed in claim 7, wherein said housing is unitarily of one piece.

* * * * *